United States Patent [19]

Cotte et al.

[11] 4,312,194

[45] Jan. 26, 1982

[54] METHOD AND ARRANGEMENT FOR NEEDLE SELECTION IN KNITTING MACHINES

[75] Inventors: Dietrich Cotte, Karl Marx Stadt; Holger Scheffler, Lichtenstein; Gunter Beyer, Limbach-Oberfrohna; Dietmar Bugge, Karl Marx Stadt; Manfred Kühn, Lichtenstein, all of German Democratic Rep.

[73] Assignee: VEB Wirkmaschinenbau Karl Marx Stadt, Karl Marx Stadt, German Democratic Rep.

[21] Appl. No.: 116,805

[22] Filed: Jan. 30, 1980

[30] Foreign Application Priority Data

Feb. 19, 1979 [DD] German Democratic Rep. ... 211066
Feb. 19, 1979 [DD] German Democratic Rep. ... 211067

[51] Int. Cl.[3] ..... D04B 7/00
[52] U.S. Cl. ..... 66/75.2
[58] Field of Search ..... 66/75.2, 60 R, 222, 66/64, 221, 231

[56] References Cited

U.S. PATENT DOCUMENTS

| | | | |
|---|---|---|---|
| 2,705,408 | 4/1955 | Mehnert | 66/64 |
| 2,821,073 | 1/1958 | Mehnert | 66/64 |
| 3,751,944 | 8/1973 | Krause | 66/64 |
| 3,760,610 | 9/1973 | Hadam et al. | 66/64 |
| 3,805,558 | 4/1974 | Protti | 66/75.2 |
| 3,910,071 | 10/1975 | Schieber et al. | 60/64 |
| 4,167,861 | 9/1979 | Krause et al. | 66/75.2 |

*Primary Examiner*—Ronald Feldbaum
*Attorney, Agent, or Firm*—Michael J. Striker

[57] ABSTRACT

In a flat-knitting machine having a needle bed and a plurality of carriages which orbit the needle bed in a predetermined path, the needles which are to knit in accordance with a predetermined pattern are selected by advancing electromechanical controllers in a path other than the predetermined path and transmitting activating signals to them via trailing cables from a stationary control unit when the controllers move in the same direction as and parallel to the carriages.

12 Claims, 6 Drawing Figures

METHOD AND ARRANGEMENT FOR NEEDLE SELECTION IN KNITTING MACHINES

BACKGROUND OF THE INVENTION

The present invention relates to knitting machines.

More particularly, the invention relates to a method of, and an arrangement for, selecting the operating needles in a knitting machine.

German Allowed Application DE-AS No. 1,044,337 discloses a knitting machine having sequentially arranged pairs of needle beds and orbiting carriages. The selection of the needles which are to knit in accordance with a predetermined pattern, is made by pattern wheels which are mounted on the respective carriages. During each orbit of the respective carriage the associated pattern wheel rolls on a stationary pattern bed and thus becomes programmed. Thereafter, the pattern wheel rolls on the needle beds and thus transmits the pattern selection made by the pattern bed to the needles of the needle beds. Inherent in all pattern wheels, however, is the limitation that they permit only very limited kinds of patterns to be knitted; more elaborate patterns cannot be made.

Since, however, there is a strong demand for such more elaborate patterns, the prior art has evolved two alternatives. From GDR Pat. No. DC 24,031 and from FRG Pat. No. DE 1,635,968 it is known to associate each needle (respectively each plunger) with an individual electromagnet which is energized from a stationary control unit in accordance with a predetermined pattern. According to the other solution, disclosed in FRG Pat. No. DE 2,010,973, the movable carriage is provided with a few electromagnetic needle selectors which are usually energized via trailing cables from a stationary control unit in accordance with the desired pattern.

The first proposal has not found much interest in the industry, since the use of a separate electromagnet for each of the many needles makes the machine complicated and expensive. It is therefore the second proposal which is usually found in practical use. However, heretofore it was not considered possible to use this proposal on flat-knitting machines with sequentially arranged pairs of needle beds and orbiting carriages, using trailing electrical cables.

For this type of machine, therefore, it is considered necessary to find a different solution. Sliding contacts, known from German Published application OS No. 2,658,588 were considered unsuitable since control signals transmitted via such sliding contacts are often distorted or otherwise changed. Electro-optical control of the needle selectors on the carriage (German Published application OS No. 2,114,013), and the use of a stationary radio transmitter and a receiver on the carriage (German Published application OS No. 2,060,942), are both complicated and expensive and were therefore ruled out.

SUMMARY OF THE INVENTION

Accordingly, it is an object of the invention to overcome the prior-art drawbacks.

A more particular object is to provide an improved method of controlling the needle-selection operation on machines of the type in question, in such a manner as to assure the reliable and economical manufacture of textiles which are patterned in any desired manner.

Another object is to provide an arrangement for carrying the inventive method into effect.

A noncomitant object is to provide for the selection of any desired pattern-forming needles on machines of the type under discussion, using known (and known-to-be-reliable) trailing cables and a few selectors for each knitting system.

These objects and still others which will become apparent hereafter, are attained by guiding the electromechanical controllers intended to act upon a needle bed, in a path which differs from the path of the carriages and that these controllers are actuated from a stationary pattern control unit via trailing cables when the controllers—which move at a distance from one another corresponding to the spacing of the knitting systems and which are each associated with adjacent knitting systems—are moving in direction of the orbiting carriges in at least a portion of a path extending parallel to the needle bed. The path of movement for the controllers may resemble a figure eight.

In an arrangement according to the invention the controllers may be arranged lengthwise of the needle bed in at least two superposed parallel rows, and the controllers associated with the respectively adjacent knitting systems may within a given row be spaced from one another at about the distance of the knitting systems and be reciprocable parallel to the row of needles.

The number of controllers associated with each knitting system are advantageously uniformly distributed over the number of rows. The displacement of the controllers may correspond to at least the distance of the knitting systems from one another, divided by the number of rows.

Within each row, and spaced from one another at the same distance as the knitting systems are spaced from each other, several controllers may be arranged staggered above one another.

The controllers in each row may be mounted on a common bar which is reciprocable. According to preferred embodiment each needle bed may have two such reciprocable bars for the controllers, and the bars may be movable in the advancement direction of the carriages at about the carriage speed, but in the opposite direction may move at a higher speed. It is advantageous if all bars have a common drive.

The controllers may be magnets, and the control of the needles may be effected by a pivot plate arranged beneath each needle and provided with pattern feet which are actuatable by the controllers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
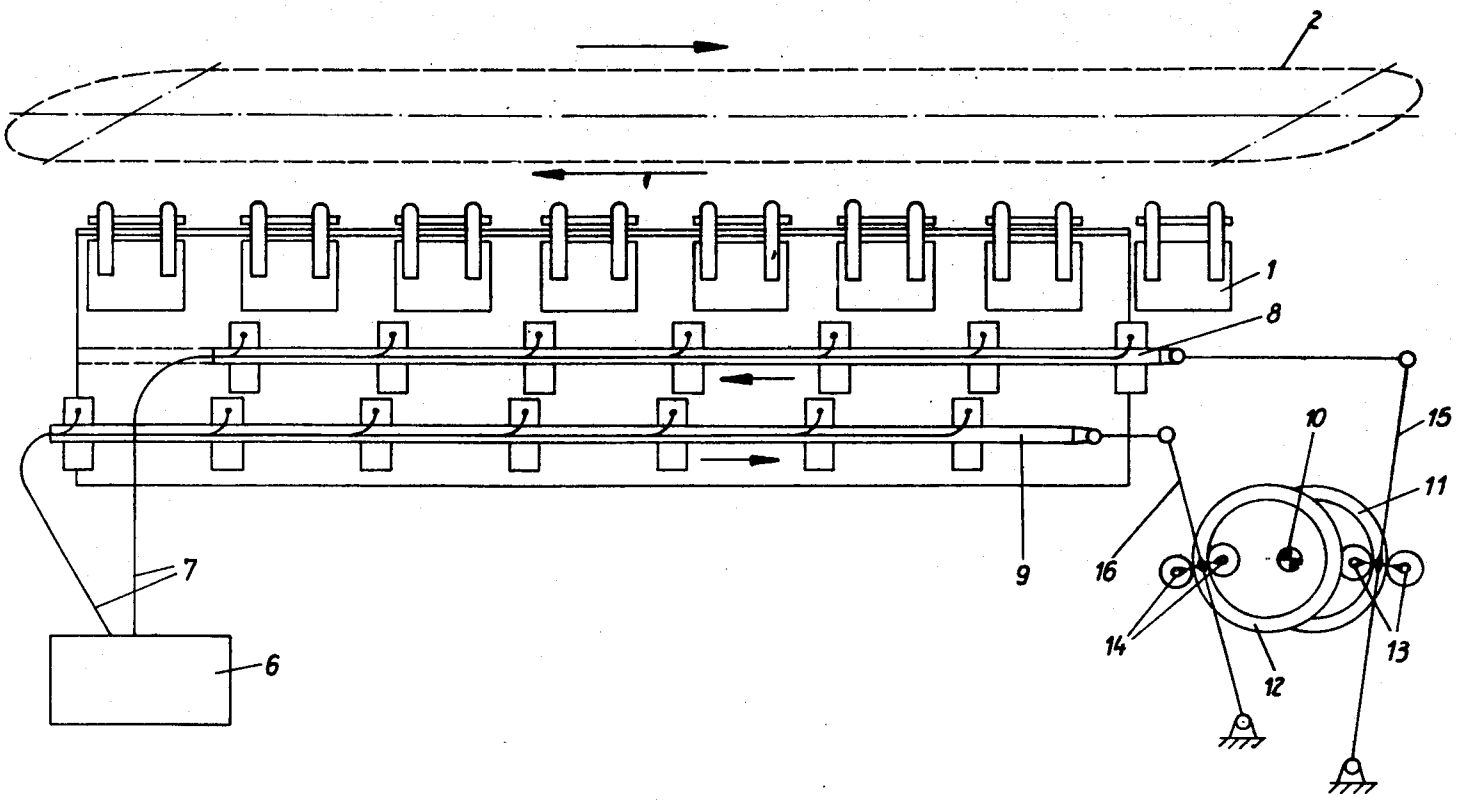
FIG. 1 is a diagrammatic side view of a knitting machine embodying the invention and provided with sequentially arranged needle-bed pairs and orbiting carriages.
Figure 2:
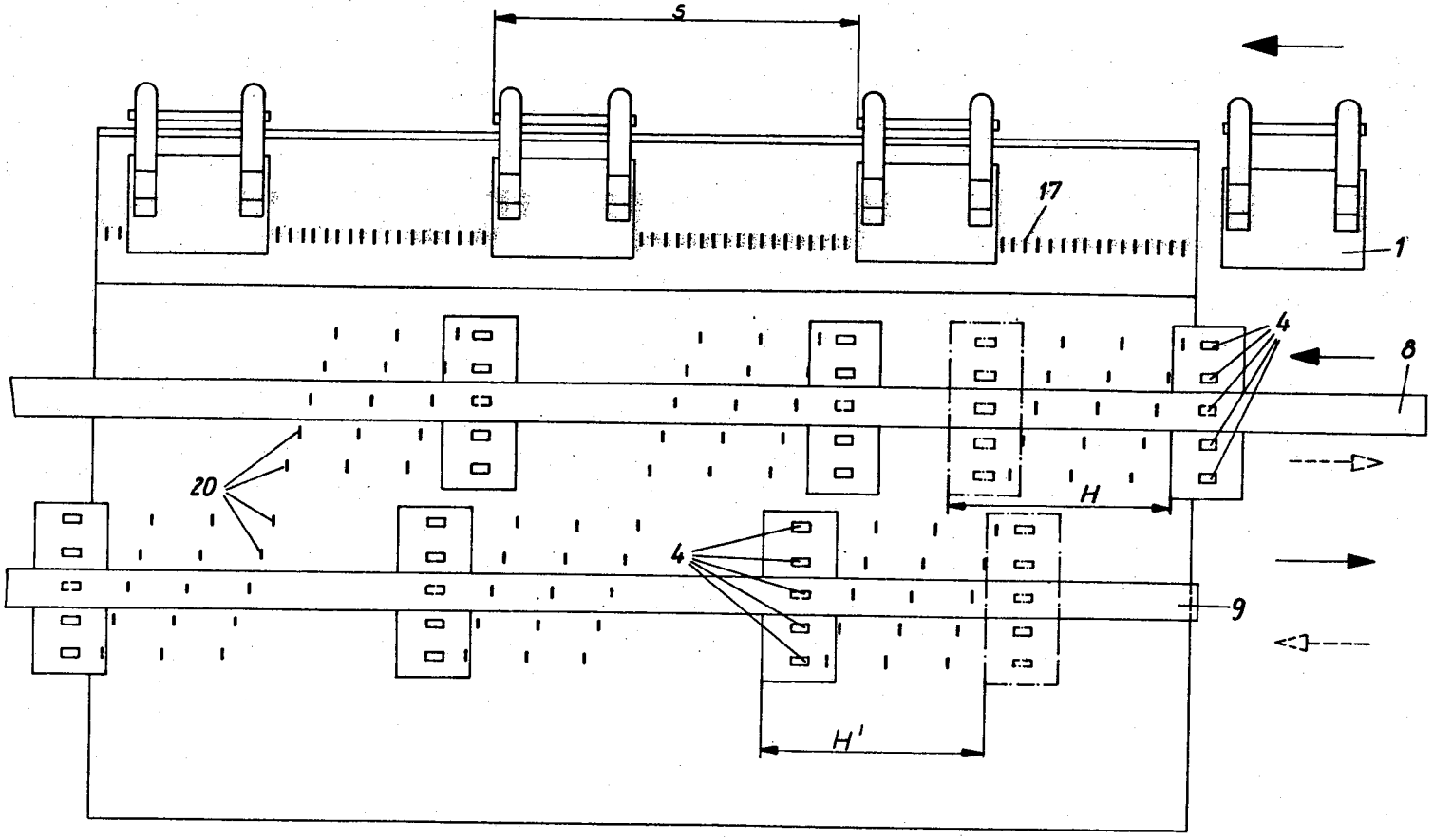
FIG. 2 is a fragmentary plan view of FIG. 1, on an enlarged scale.
Figure 3:
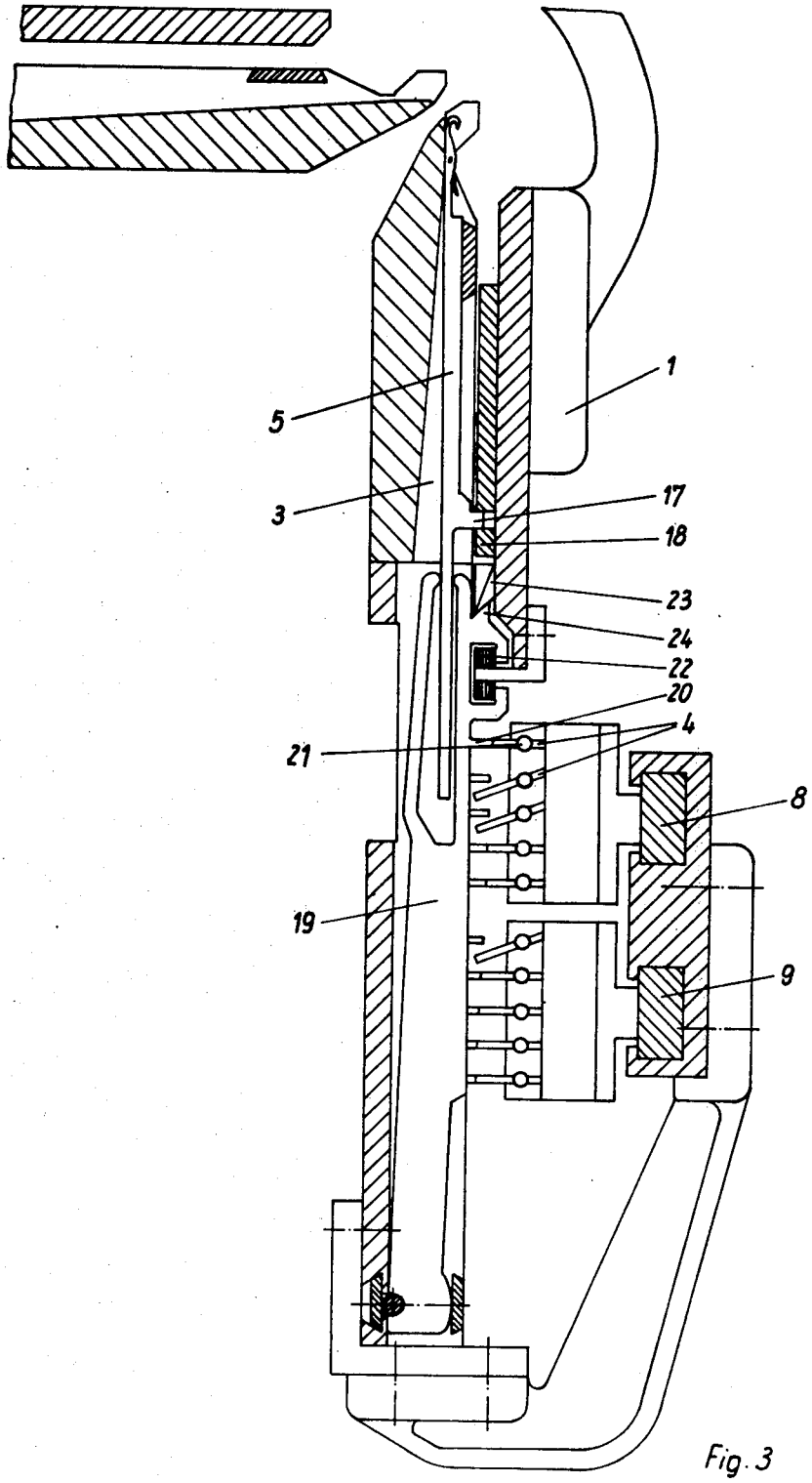
FIG. 3 is a cross-section, through a needle bed of the machine in FIG. 1, on an enlarged scale.

A first embodiment of the invention is shown in FIGS. 1–3 by way of a flat-knitting machine having carriages 1 which constantly orbit in a continuous (closed) track or path 2 above two sequentially arranged pairs of needle beds.

Needle-selecting controllers 4 are arranged in two superposed rows which extend parallel to the needle bed 3; the controllers serve to select—from among the available needles—those which are to knit at a given time in order to produce a pattern in accordance with a predetermined pattern program (not part of the invention). The controllers 4 are connected with a stationary control unit 6 via trailing cables 7 and reciprocate by row parallel to the needle bed 3. The controllers 4 associated with the adjacent knitting systems are arranged within each row at a distance from one another which corresponds to about the spacing between the adjacent knitting systems (i.e. between the carriages 1). The controllers 4 are advantageously mounted on slidable bars 8 and 9 which have a common drive, e.g. a shaft 10 with differently shaped cam tracks 11, 12 which act via rollers 13, 14 upon the arms 15, 16.

The controllers 4 of any one knitting system are arranged within the respective row on the bars 8, 9 and in staggered superposed relationship, as shown in FIGS. 1–3. The knitting needles 5 each have an engagement foot 17, the engagement or disengagement of which with the engaging members 18 of the carriages 1 is controllable by a pattern foot 20 via a tilt plate 19. The upper end of the plate 19 is for this purpose provided with a fork which engages the lower end of the needle 5. The staggered pattern feet 20 of the plates 19 can be actuated in a pattern-controlling sense by the controllers 4 which in known manner can be tilted about an axis 21 from an inclined rest position to an active horizontal position, by electromagnets (not illustrated).

At the end of each knitting system (i.e. of each carriage 1) a member 22 is provided for radially acting upon the plates 19 in direction transverse to the needle expulsion direction. Another part 23 on each carriage 1 cooperates with a retaining foot 24 of the respective tilt plate 19 and serves to arrest the plates 19 in their respective positions.

When the machine of FIGS. 1–3 operates the carriages 1 constantly orbit in their path 2 above the two needle-bed pairs of the machine. The controllers 4 of a row—respectively those mounted on the bar 8 or 9—move approximately synchronously with the carriages 1 but somewhat in front of them. FIG. 2 illustrates the controllers 4 on bar 8 being moved in approximate synchronism with the carriages 1, so as to push out the pattern feet 20 of the tilt plate 19 in accordance with the electrical commands transmitted by the control unit 6 via the trailing cables 7.

Prior to their pattern-related selection all tilt plates 19 are in the position shown in FIG. 3, to which they have previously been moved by the part 22 of the preceding carriage. If the control unit yields no signal to activate a particular controller, then the same remains in its position and the pattern foot 20 of the associated tilt plate 19 is not pushed out; i.e. the plate 19 in the FIG. 3 position and the needle associated with it is pushed out of its rest position by the part 18. If the controller 4 is activated by a command from unit 6, then it assumes a horizontal position and thus engages the pattern foot 20 of the respective tilt plate 19, causing the tilt plate 19 to be pivoted inwardly about its lower end and the associated needle 5 to be pushed deeper into the needle bed 3, so that the needle foot 17 moves out of the range of part 18. During this operation the bar 8 moves synchronously with the carriage 1 through a distance H which, in the particular illustrated embodiment, is slightly greater than half of the spacing S between the knitting systems. At the same time the bar 9 (starting from the position shown in FIG. 2) has been moved through the distance H′ in direction counter to the carriage movement (i.e. as indicated by the full-line arrow) at a speed which is somewhat higher than the carriage speed, so that now the farthest to right controllers 4 on bar 9 are in the position shown in broken lines in FIG. 2. The controllers 4 of the bar 9 now move synchronously with the carriage 1 through the distance H′ (H=H′) and effect—in accordance with the signals from the device 6—the pattern-coordinated tilting of the tilt-plates 19 while the controllers 4 mounted on bar 8 return to their position which is shown in full lines in FIG. 2. The alternate-direction displacement of the bars 8 and 9 is effected by shaft 10 via cams 11, 12 and the rollers 13, 14 of the arms 15, 16.

Figure 4:
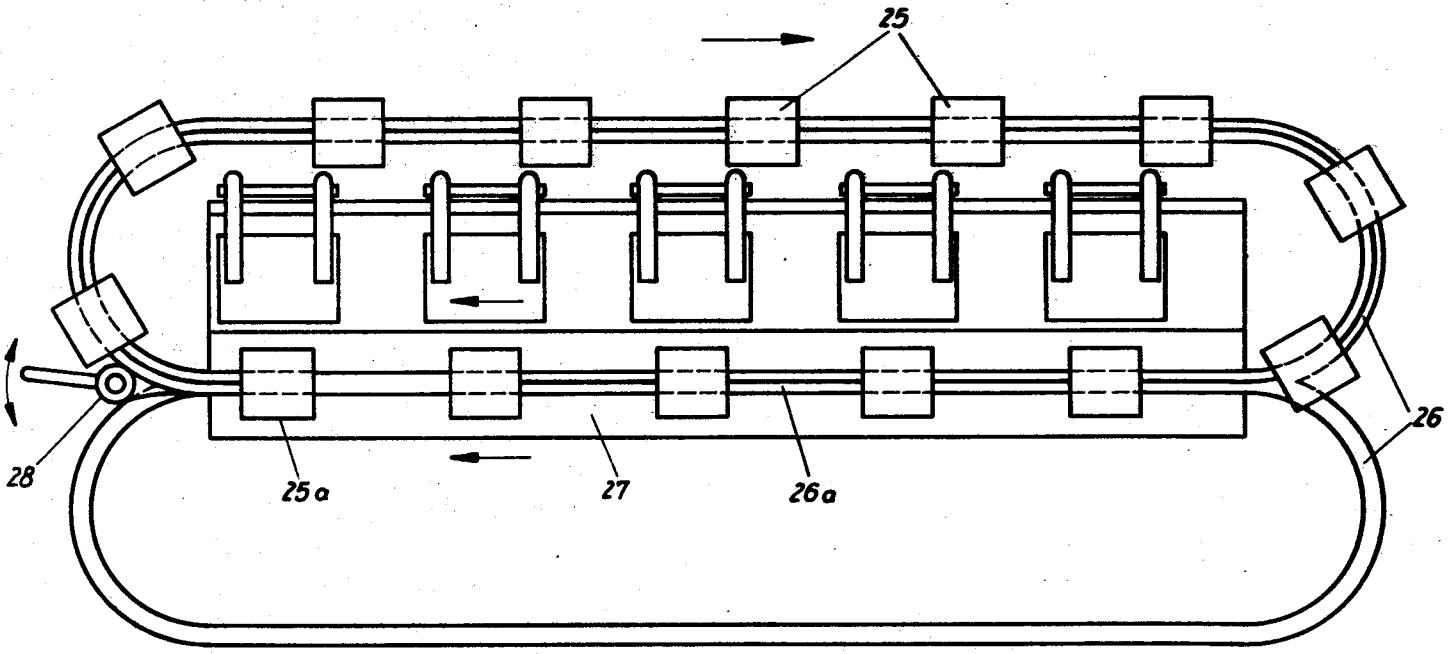
FIG. 4 is a side view analogous to FIG. 1 but illustrating a different embodiment in which the controllers for the needles move in a track resembling a figure eight.
Figure 5:
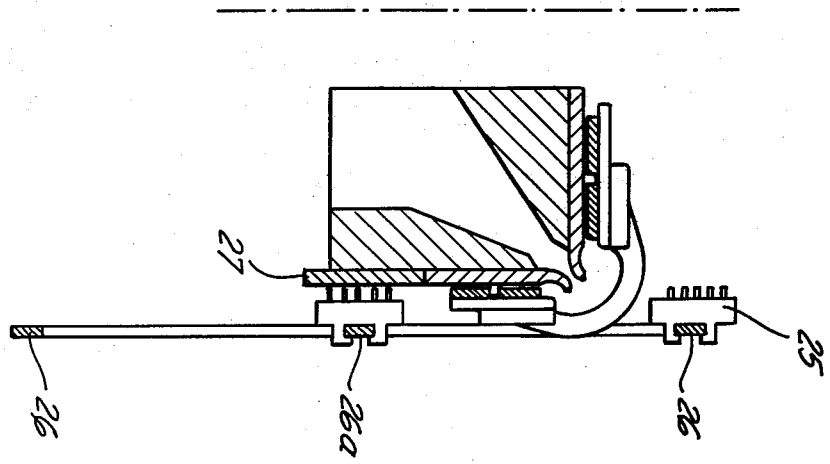
FIG. 5 is a vertical section through FIG. 4, analogous to the section in FIG. 3 and looking towards the right in FIG. 4.
Figure 6:
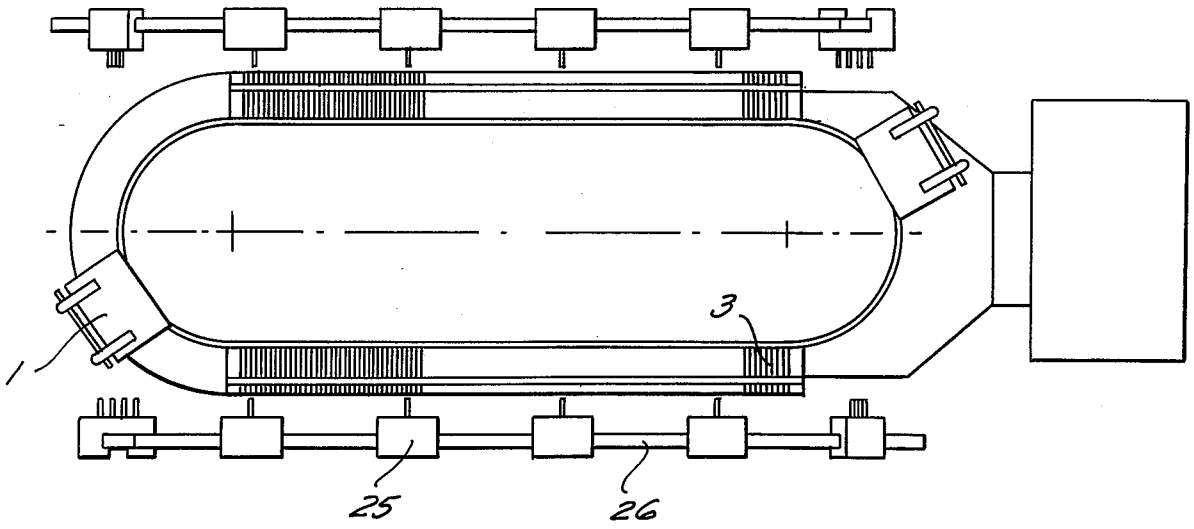
FIG. 6 is a top plan view of FIG. 4, only two orbiting carriages being shown for simplicity.

In the embodiment of FIGS. 4–6 the controllers 4 intended for cooperation with a respective knitting system are mounted on supports 25 which move in a track 26 having the shape of a figure eight. In the portion 26*a*—which extends parallel to the needle bed 27 with its sequential needle-bed pairs and orbiting carriages—the supports 25 move in synchronism with the orbiting carriages 1, and their controllers 4 select the needles in accordance with the commands received from a stationary control unit (not shown), which commands are transmitted to the controllers 4 as electrical signals via trailing cables.

To assure that the supports 25 do in fact travel in a figure eight-shaped track, a diverter 28 is provided which is switched over after all supports 25—here fourteen of them—have moved past it.

FIG. 4 does, in fact, show exactly the point in time at which a switch-over of the diverter 28 is effected, so that the support 25*a* which is just leaving the needle bed 27 and the thereafter following thirteen supports 25, now moves through the lower loop of the figure eight-shaped track. The use of a track of this shape permits the transmission of signals to the controllers from a stationary control unit via trailing cables, since the cables receive no lasting twist during complete travel through the figure eight-shaped track.

While the invention has been illustrated and described as embodied in a flat-knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of selecting pattern-knitting needles in knitting machines having at least one stationary needle bed and a plurality of successively operating knitting systems travelling in a path, comprising the steps of providing electromechanical needle selectors; advancing said needle selectors in a track different from said path; and supplying needle-selecting signals to said selectors from a stationary control and via trailing cables when the selectors are moving in direction of the travelling knitting systems over at least a portion of said track which extends parallel to said path.

2. A method as defined in claim 1, wherein the selectors are associated with adjacent knitting systems and are spaced from one another by a distance corresponding to the spacing between the adjacent knitting systems.

3. A method as defined in claim 1, wherein said selectors are advanced in a track resembling a figure eight.

4. An arrangement for selecting pattern-knitting needles in a knitting machine having at least one needle bed and a plurality of carriages orbiting said needle bed in a predetermined path, comprising a plurality of electromechanical needle-selecting controllers; means forming a track for said controllers which is different from said path but has a portion parallel to said path; means for moving said controllers along said track; and means, including a stationary control unit and trailing cables extending therefrom to said controllers, for transmitting needle-selecting signals to said controllers when the controllers move in said track position parallel to said path and in the same direction as said carriages.

5. An arrangement as defined in claim 4, wherein said controllers are arranged lengthwise of the needle bed in at least two superposed parallel rows, the successive controllers of each row being spaced from one another by a distance corresponding substantially to the distance between said carriages and wherein said moving means comprises means for reciprocating each row of controllers in parallelism with said needle bed.

6. An arrangement as defined in claim 5, wherein the controllers associated with a particular carriage are uniformly distributed over the number of rows of controllers.

7. An arrangement as defined in claim 5, wherein the spacing between said controllers corresponds at least to the distance between said carriages divided by the number of said rows.

8. An arrangement as defined in claim 5, wherein a plurality of said controllers are arranged within each row staggered and superposed and spaced at the same distance as said carriages from one another.

9. An arrangement as defined in claim 5, wherein all controllers of a respective row are mounted on a common reciprocable bar.

10. An arrangement as defined in claim 5, wherein all controllers of a respective row are mounted on one of two common reciprocable bars, and wherein said bars move in the direction of advancement of said carriages at substantially the same speed as the carriages and move opposite to said direction at a higher speed.

11. An arrangement as defined in claim 10; further comprising a common drive for said bars.

12. An arrangement as defined in claim 5; further comprising a plurality of needles; a plurality of tilt plates each tiltably mounted below one of said needles and having a pattern foot engageable by respective ones of said controllers.

* * * * *